US008265941B2

(12) United States Patent
Oh et al.

(10) Patent No.: US 8,265,941 B2
(45) Date of Patent: Sep. 11, 2012

(54) METHOD AND AN APPARATUS FOR DECODING AN AUDIO SIGNAL

(75) Inventors: Hyen O Oh, Seoul (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 513 days.

(21) Appl. No.: 12/517,903

(22) PCT Filed: Dec. 6, 2007

(86) PCT No.: PCT/KR2007/006297

§ 371 (c)(1),
(2), (4) Date: Oct. 8, 2009

(87) PCT Pub. No.: WO2008/069584

PCT Pub. Date: Jun. 12, 2008

(65) Prior Publication Data

US 2011/0040567 A1 Feb. 17, 2011

Related U.S. Application Data

(60) Provisional application No. 60/869,077, filed on Dec. 7, 2006, provisional application No. 60/869,080, filed on Dec. 7, 2006, provisional application No. 60/883,567, filed on Jan. 5, 2007, provisional application No. 60/889,715, filed on Feb. 13, 2007, provisional application No. 60/955,395, filed on Aug. 13, 2007, provisional application No. 60/970,524, filed on Sep. 6, 2007.

(51) Int. Cl.
*G10L 19/00* (2006.01)

(52) U.S. Cl. ..... 704/501; 704/200; 704/200.1; 704/201; 704/500

(58) Field of Classification Search ..... 704/200–201, 704/500–504

See application file for complete search history.

(56) References Cited

U.S. PATENT DOCUMENTS 5,682,433 A 10/1997 Pickard et al.

(Continued)

FOREIGN PATENT DOCUMENTS

EP 1 107 232 A2 6/2001

(Continued)

OTHER PUBLICATIONS

Faller, Christof, et al., "Binaural Cue Coding Applied to Audio Compression with Flexible Rendering", Audio Engineering Society, Convention Paper 5686, Presented at the 113th Convention, Los Angeles, CA, USA, Oct. 5-8, 2002, 10 pages.

(Continued)

*Primary Examiner* — Douglas Godbold

(74) *Attorney, Agent, or Firm* — Birch, Stewart, Kolasch & Birch, LLP

(57) ABSTRACT

A method for decoding an audio signal comprises receiving a combined downmix, a combined object information, and a mix information, the combined downmix being generating using at least two downmix signals, the combined object information being made by combination of at least two sets of object information, generating a downmix processing information using the combined object information and the mix information, and processing the combined downmix using the downmix processing information.

The method and an apparatus for decoding an audio signal comprising the combined downmix and the combined object information can control object gain and output in a remote conference and so on.

The method and the apparatus for decoding audio signal that contains multi-object signals are fast and efficiently by reducing process time, computer resource, thereby relieving the resource requirement like the wide bandwidth by using the combined object information.

13 Claims, 9 Drawing Sheets

U.S. PATENT DOCUMENTS

| | | | | |
|---|---|---|---|---|
| 5,974,380 | A | 10/1999 | Smyth et al. | |
| 6,026,168 | A | 2/2000 | Li et al. | |
| 6,122,619 | A | 9/2000 | Kolluru et al. | |
| 6,128,597 | A | 10/2000 | Kolluru et al. | |
| 6,131,084 | A | 10/2000 | Hardwick | |
| 6,141,446 | A | 10/2000 | Boliek et al. | |
| 6,496,584 | B2 | 12/2002 | Irwan et al. | |
| 6,584,077 | B1 | 6/2003 | Polomski | |
| 6,839,438 | B1 | 1/2005 | Riegelsberger et al. | |
| 6,952,677 | B1 | 10/2005 | Absar et al. | |
| 7,103,187 | B1 | 9/2006 | Neuman | |
| 7,672,744 | B2 | 3/2010 | Oh et al. | |
| 2003/0023160 | A1 | 1/2003 | Minkoff et al. | |
| 2003/0026441 | A1* | 2/2003 | Faller | 381/98 |
| 2003/0117759 | A1 | 6/2003 | Cooper | |
| 2003/0236583 | A1 | 12/2003 | Baumgarte et al. | |
| 2004/0111171 | A1 | 6/2004 | Jang et al. | |
| 2004/0161116 | A1 | 8/2004 | Tsuji et al. | |
| 2005/0074127 | A1 | 4/2005 | Herre et al. | |
| 2005/0089181 | A1 | 4/2005 | Polk, Jr. | |
| 2005/0117759 | A1 | 6/2005 | Wu | |
| 2005/0157883 | A1* | 7/2005 | Herre et al. | 381/17 |
| 2005/0157884 | A1 | 7/2005 | Eguchi | |
| 2005/0169482 | A1 | 8/2005 | Reams et al. | |
| 2005/0195981 | A1* | 9/2005 | Faller et al. | 381/23 |
| 2006/0085200 | A1 | 4/2006 | Allamanche et al. | |
| 2006/0109992 | A1 | 5/2006 | Roeder et al. | |
| 2006/0115100 | A1* | 6/2006 | Faller | 381/119 |
| 2006/0133618 | A1 | 6/2006 | Villemoes et al. | |
| 2006/0190247 | A1 | 8/2006 | Lindblom | |
| 2007/0083365 | A1 | 4/2007 | Shmunk | |
| 2007/0165869 | A1 | 7/2007 | Ojanpera | |
| 2007/0280485 | A1* | 12/2007 | Villemoes | 381/22 |
| 2008/0002842 | A1* | 1/2008 | Neusinger et al. | 381/119 |
| 2008/0008323 | A1 | 1/2008 | Hilpert et al. | |
| 2009/0164222 | A1 | 6/2009 | Kim et al. | |
| 2011/0196685 | A1 | 8/2011 | Kim et al. | |

FOREIGN PATENT DOCUMENTS

| | | | |
|---|---|---|---|
| EP | 1 107 232 | A3 | 6/2001 |
| EP | 1416769 | A1 | 5/2004 |
| EP | 1565036 | A2 | 8/2005 |
| EP | 1 640 972 | A1 | 3/2006 |
| EP | 1 691 348 | A1 | 8/2006 |
| EP | 2092518 | A1 | 8/2009 |
| JP | 2003-66994 | A | 3/2003 |
| JP | 200480735 | A | 3/2004 |
| JP | 2004170610 | A | 6/2004 |
| JP | 2006323408 | A | 11/2006 |
| JP | 2007-507731 | A | 3/2007 |
| JP | 2007-519349 | A | 7/2007 |
| JP | 2008-530618 | A | 8/2008 |
| JP | 2009-543142 | A | 12/2009 |
| JP | 2010-505141 | A | 2/2010 |
| KR | 1020000053152 | A | 8/2000 |
| KR | 1020060049941 | A | 5/2006 |
| KR | 1020060049980 | A | 5/2006 |
| KR | 20060060927 | A | 6/2006 |
| RU | 2 214 048 | C2 | 10/2003 |
| RU | 2005 104 123 | A | 7/2005 |
| WO | WO-8204314 | A1 | 12/1982 |
| WO | WO-9212607 | A1 | 7/1992 |
| WO | WO-9858450 | A1 | 12/1998 |
| WO | WO-03090207 | A1 | 10/2003 |
| WO | WO-03090208 | A1 | 10/2003 |
| WO | WO 2004/008806 | A1 | 1/2004 |
| WO | WO-2005029467 | A1 | 3/2005 |
| WO | WO-2005086139 | A1 | 9/2005 |
| WO | WO-2006002748 | A1 | 1/2006 |
| WO | WO-2006008683 | A1 | 1/2006 |
| WO | WO-2006048226 | A1 | 5/2006 |
| WO | WO 2006/060279 | A1 | 6/2006 |
| WO | WO-2006084916 | A2 | 8/2006 |
| WO | WO-2006132857 | A2 | 12/2006 |
| WO | WO-2007013775 | A1 | 2/2007 |
| WO | WO-2008035275 | A2 | 3/2008 |
| WO | WO-2008046530 | A2 | 4/2008 |
| WO | WO 2008/080111 | A1 | 5/2008 |

OTHER PUBLICATIONS

Engdegard, Jonas, et al., "Spatial Audio Object Coding (SAOC)—The Upcoming MPEG Standard on Parametric Object Based Audio Coding", Audio Engineering Society Convention Paper 7377, Presented at the 124th Convention, Amsterdam, The Netherlands, May 17-20, 2008, 15 pages.

Faller, Christof, "Parametric Joint-Coding of Audio Sources", Audio Engineering Society, Convention Paper 6752, Presented at the 120th Convention, May 20-23, Paris, France, 15 pages.

Breebaart, J., et al., "MPEG Spatial Audio Coding/MPEG Surround: Overview and Current Status", Audio Engineering Society, Convention Paper 6599, Presented at the 119th Convention, New York, New York, USA, Oct. 7-10, 2005, 17 pages.

Vera-Candeas, P., et al., "A new Sinusoidal Modelling Approach for Parametric Speech and Audio Coding", Proceedings of the 3rd International Symposium on Image and Signal Processing and Analysis, 2003, pp. 134-139.

Faller, Christof, "Coding of Spatial Audio Compatible with Different Playback Formats", Audio Engineering Society, Convention Paper, Presented at the 117th Convention, San Francisco, CA, USA, Oct. 28-31, 2004, 12 pages.

Liebchen, Tilman, et al., "The MPEG-4 Audio Lossless Coding (ALS) Standard—Technology and Applications", Audio Engineering Society, Convention Paper, Presented at the 119th Convention, Oct. 7-10, New York, NY, USA,14 pages.

Liebchen, Tilman, et al., "Improved Forward-Adaptive Prediction for MPEG-4 Audio Lossless Coding" Audio Engineering Society, Convention Paper, Presented at the 118th Convention, May 28-31, 2005, Barcelona, Spain, 10 pages.

De Smet, Patrick, et al., "Subband Based MPEG Audio Mixing for Internet Streaming Applications", IEEE 2001, pp. 1393-1396.

Kim, Jong-Hwa, "Lossless Wideband Audio Compression: Prediction and Transform", Technische Universitat Berlin, 2003, 203 pages.

Faller, Christof, "Parametric Coding of Spatial Audio" Doctoral Thesis No. 3062, 2004, 180 pages.

"Draft Call for Proposals on Spatial Audio Object Coding" Joint Video Team (JVT) of ISO/IEC Mpeg & ITU-T VCEG (ISO/IEC JTC1/SC29/WG11 and ITU-T SG16 Q6), No. N8639, Oct. 27, 2006, XP030015133.

Villemoes, "MPEG Surround: The Forthcoming ISO Standard for Spatial Audio Coding", AES 28th Internation Conference, Jun. 30 to Jul. 2, 2006, pp. 1-18, Pitea, Sweden.

* cited by examiner

METHOD AND AN APPARATUS FOR DECODING AN AUDIO SIGNAL

This application is the National Phase of PCT/KR2007/006297 filed on Dec. 6, 2007, which claims priority under 35 U.S.C. 119(e) to U.S. Provisional Application Nos. 60/869,077, 60/869,080, 60/883,567, 60/889,715, 60/955,395 and 60/970,524 filed on Dec. 7, 2006, Dec. 7, 2006, Jan. 5, 2007, Feb. 13, 2007, Aug. 13, 2007 and Sep. 6, 2007; respectively all of which are hereby expressly incorporated by reference into the present application.

TECHNICAL FIELD

The present invention relates to a method and an apparatus for decoding an audio signal, and more particularly, to a method and an apparatus for decoding an audio signal received via various digital medium.

BACKGROUND ART

MCU (Mutipoint Control Unit) is a device that it can be used teleconference to articulate provided signals from remote place through conference call. The MCU establishes conference calls between three or more people for converged audio signal (included voice), video signal and data conferences.

Often referred to as a bridge, an MCU can provide audio-only services or any combination of audio, video and data, depending on the capabilities of each participant's terminal. A conventional MCU generally makes a combined downmix signal using at least two downmix signals for teleconference.

The conventional MCU can t control gain and panning of each signal which is constituted the downmix signals, output signal of the conventional MCU. Therefore, to control the individual object signals, the input signal of the conventional MCU can be audio signal that contains multi-object signals.

However, an apparatus and method for decoding whole multi-object signals needs a wide bandwidth. Accordingly, a new apparatus and method for decoding multi-object signals is needed to relieve the resource requirement like the wide bandwidth.

SUMMARY OF THE INVENTION

Accordingly, the present invention has been made keeping in mind the above problems, and is directed to a method and an apparatus for decoding an audio signal that substantially improves disadvantages of the related art and obviates one or more problems of related art.

An object of the present invention is to provide a method or apparatus for decoding an audio signal by using object information including an object level information and an object gain information to modify the downmix signal as changing the contribute of each object to each downmix channel.

Another object of the present invention is to provide a method and an apparatus for decoding an audio signal, comprising a combined downmix and a combined object information, to control object gain and output in a remote conference and so on.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

Various embodiments of the present invention provide a method and an apparatus for decoding audio signal that contains multi-object signals fast and efficiently by reducing process time, computer resource, thereby relieving the resource requirement like the wide bandwidth.

BRIEF DESCRIPTION OF THE DRAWINGS

The accompanying drawings, which are included to provide a further understanding of the invention, illustrate the preferred embodiments of the invention, and together with the description, serve to explain the principles of the present invention. In the drawings.

DESCRIPTION OF EMBODIMENTS OF THE PRESENT INVENTION

To achieve the objects and other advantages in accordance with the purpose of the invention, as embodied and broadly described herein, the present invention of decoding method for an audio signal comprises receiving a combined downmix, a combined object information, and a mix information, the combined downmix being generating using at least two downmix signals, the combined object information being made by combination of at least two sets of object information; generating a downmix processing information using the combined object information and the mix information; and processing the combined downmix using the downmix processing information.

It is to be understood that both the foregoing general description and the following detailed description of the present invention are exemplary and explanatory and are intended to provide further explanation of the invention as claimed.

Reference will now be made in detail to the preferred embodiment of the present invention, examples of which are illustrated in the accompanying drawings. Wherever possible, the same reference numbers will be used throughout the drawings to refer to the same or like parts.

Prior to describing the present invention, it should be noted that most terms disclosed in the present invention correspond to general terms well known in the art, but some terms have been selected by the application as necessary and will hereinafter be disclosed in the following description of the present invention. Therefore, it is preferable that the terms defined by the applicant be understood on the basis of their meanings in the present invention.

Figure 1:
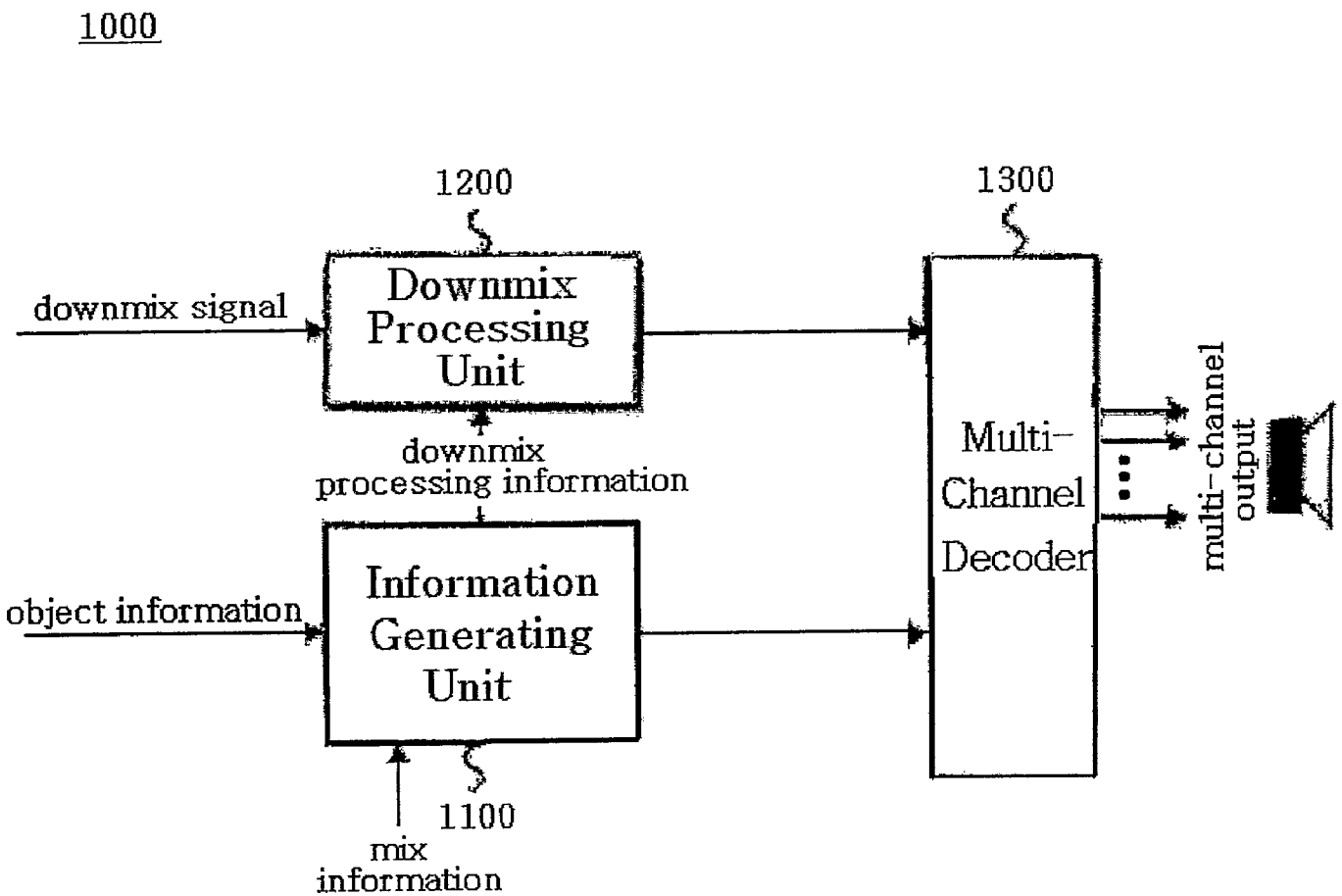
FIG. 1 is an exemplary block diagram of an apparatus for decoding an audio signal according to one embodiment of the present invention.
Figure 3:
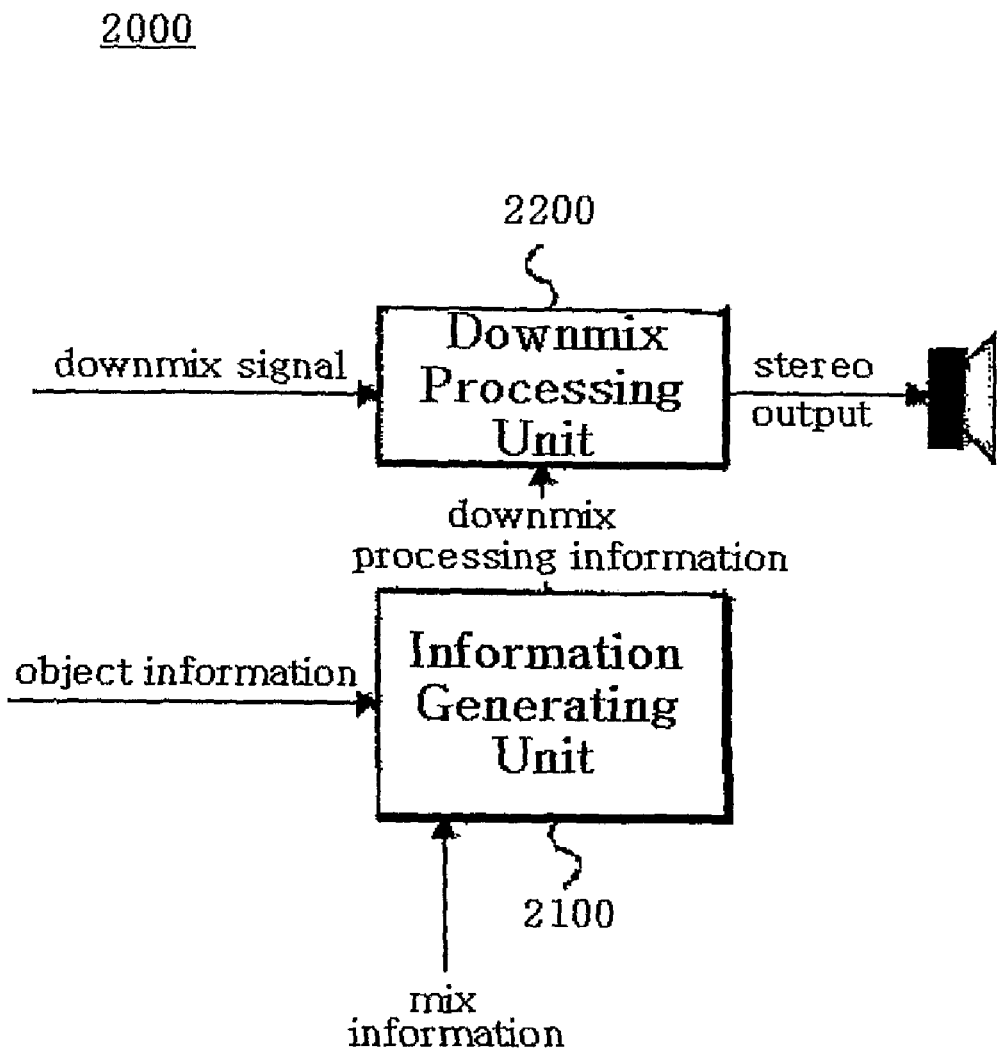
FIG. 3 is an exemplary block diagram of an apparatus for decoding an audio signal according to other embodiment of the present invention.

FIG. 1 is an exemplary block diagram of an apparatus 1000 for decoding an audio signal according to one embodiment of the present invention. FIG. 3 is an exemplary block diagram of an apparatus 2000 for decoding an audio signal according to other embodiment of the present invention.

The two embodiments of the apparatus 1000 and 2000 have a difference in that the apparatus 1000 has a multi-channel decoder 1300 while the apparatus 2000 doesn't have the multi-channel decoder 1300. Other elements, such as a parameter generating unit 1100 and 2000 and a downmix processing unit 1200 and 2200 are the same as that of FIGS. 1 and 3

Referring to FIG. 1, an apparatus 1000 for decoding an audio signal (hereinafter simply referred as 'a decoder 1000') includes a parameter generating unit 1100, a downmix processing unit 1200, and a multi-channel decoder 1300. The parameter generating unit 1100 is configured to receive an object information and a mix information from a user control or a bitstream, and to generate a downmix processing information.

The object information includes an object level information, an object correlation information, and an object gain information. The object level information can be generated by normalizing an object level corresponding to each object using one of the object levels as a reference information. The object correlation information can be provided from combination of two selected objects. The object gain information includes an object gain value information or an object gain ratio information. The downmix processing information includes a parameter for controlling object gain and object panning, which is inputted to the downmix processing unit 1200.

The downmix processing unit 1200 is configured to receive a downmix signal and the downmix processing information from the information generating unit 1100. The downmix processing unit 1200 can process the downmix using the downmix processing information, thereby generate the processed downmix signal. For example, the downmix processing unit 1200 can apply the downmix processing information to the downmix signal to modify the downmix signal, so as to generate the processed downmix.

The processed downmix may be inputted to the multi-channel decoder 1300 to be upmixed and outputted by an output device such as speakers. A multi-channel parameter output from the information generating unit may be also inputted to the multi-channel decoder 1300. In some embodiments of the present invention, MPEG Surround decoder can be used for the multi-channel decoder 1300.

Figure 2:
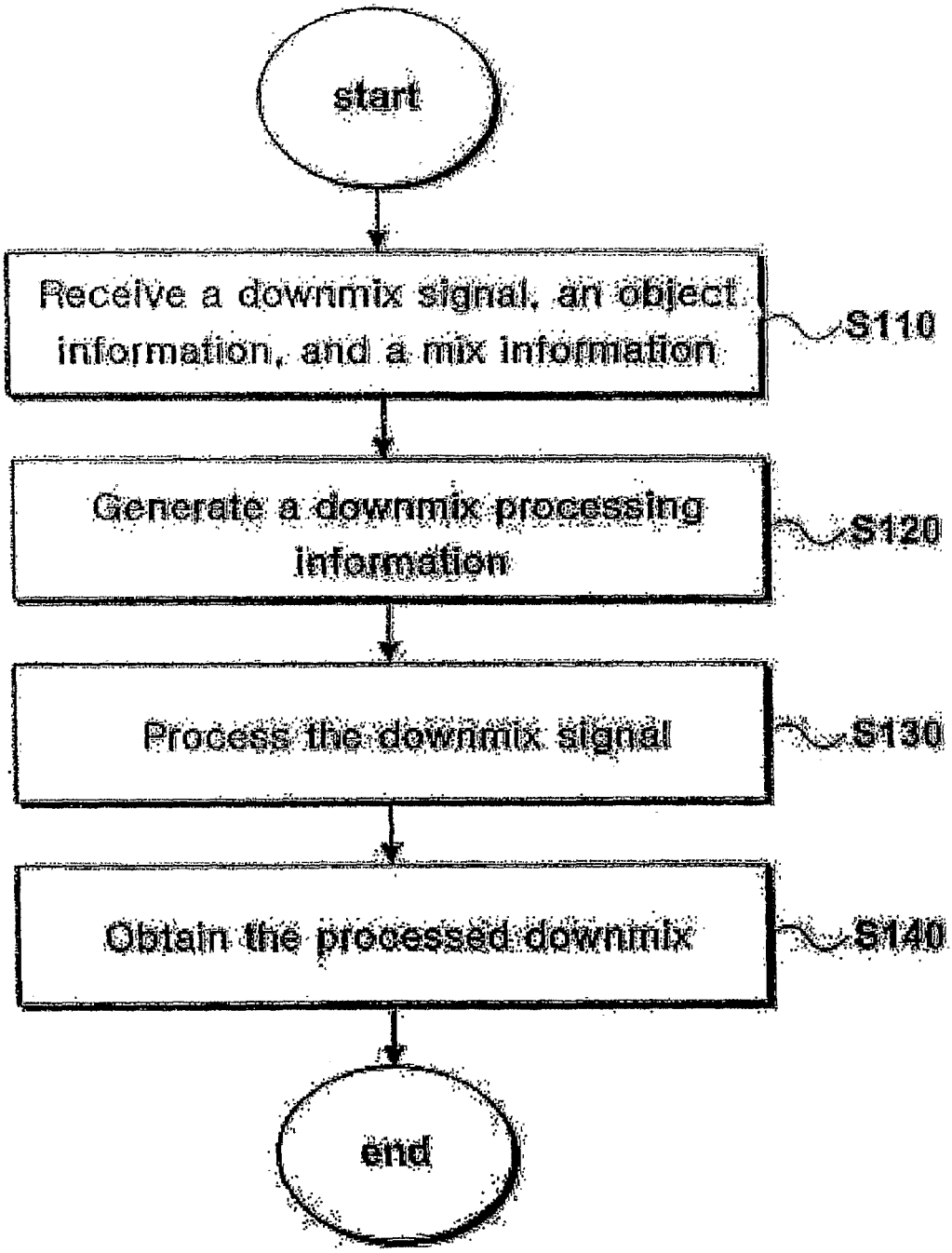
FIG. 2 is a flow chart illustrating an audio signal decoding method in accordance with an embodiment of the present invention.

Alternatively, the processed downmix signal may be directly transmitted to and outputted by the output device as the device 2000 shown in FIG. 2. In order to directly output the processed signal via speakers, the downmix processing unit 2200 may output signal. It is also able to select whether to directly output signal or input to the multi-channel decoder.

FIG. 2 shows a flowchart of the present invention, and refers also to the FIG. 1. The method is a flow path of a decoding method for an audio signal. In step S110, a downmix signal, an object information, and a mix information are received. Step 120 generates a downmix processing information using the object information and the mix information. In step S130, a processed downmix is generated by processing the downmix signal using the downmix processing information.

The configuration of the parameter generating unit 1100 shall be explained in detail with reference to FIG. 4 to FIG. 6.

1. Object Information 1.1 Reference Information and Object Level Information

Figure 4:
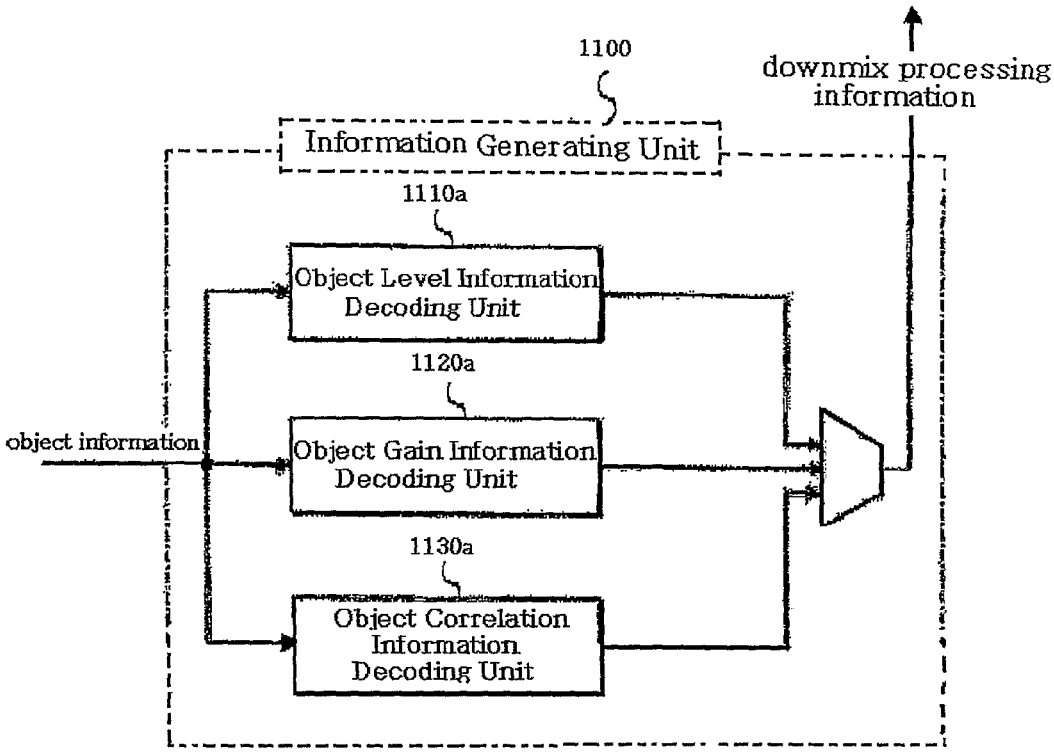
FIG. 4 is an exemplary block diagram of a information generating unit according to one embodiment of the present invention.

FIG. 4 is an exemplary block diagram of an apparatus for processing an audio signal according to one embodiment of present invention, in particular, an exemplary block diagram of the information generating unit. Referring to FIG. 4, the information generating unit 1100 can be configured to receive an object information, and to generate a downmix processing information using the object information.

The information generating unit 1100 can include an object level information decoding unit 1110*a*, an object gain information decoding unit 1120*a*, and an object correlation information decoding unit 1130*a*.

The object level information is generated by normalizing the object level using reference information, the reference information may be one of the object level, more particular, the reference information may be the largest object level among the all object levels.

For example, it is assumed that the downmix signal includes object s_i, and the object level of each object s_i is Ps_i. Here, "s_i(n)" refers to the $i^{th}$ object signal, and the s_i(n) can be either a time domain signal, or subband signal within a given band, and Ps_i denotes the level of i-th object.

Ps_i can be obtained by various methods. For example, Ps_i may be "s_i(n)^2" or "E[s_i(n)^2]".

However, if the object level information corresponding to each object signal is transmitted as the value itself the object level of an object signal may be difficult to be quantized due to an excessive increase in a variation of a dynamic range.

Thus, the object level information may be normalized using the reference information, the largest object level of all object levels. If the reference information may be Ps_r, the object level information, OL_i, may be estimated as in Equation below:

$$OL_i = Ps_i / Ps_r \quad \text{[Math Figure 1]}$$

All of the object level information is comprised a range of equal or less than 1. Therefore, a dynamic range can be compressed enough to encode an audio signal.

Additionally, the object level information may include default information, original object level to use for other signal process. The object level information corresponds to each object, and the number of the object level information is same as the number of the objects in the downmix.

1.2 Object Gain Information

The object information comprises an object gain information including at least one of an object gain value information and an object gain ratio information. FIG. 5 is an exemplary block diagram of an apparatus for processing an audio signal according to one embodiment of present invention, in particular, an exemplary block diagram of the object gain information decoding unit of the information generating unit 1100.

The object gain information decoding unit 1120*a* includes an object gain value information generating unit 1121 and an object gain ratio information generating unit 1122. The object gain information relates to modify a downmix signal having more than one channel as changing the contribute of each object to each downmix channel.

1.2.1 Object Gain Value Information

The object gain value information comprises a gain value to an object to modify the downmix signal as changing the contribute of each object to each downmix channel.

In some embodiments of the present invention, the object gain is applied to each object when generating the downmix signal.

For example, when the downmix signal includes a plurality of objects, each object gain value information corresponding to each object is multiplied to the each object signal to generate each gained object, and all of the gained objects are summed to generate the processed downmix.

$$x=\mathrm{sum}\{a_i*s_i\}$$ [Math Figure 2]

where x is downmix to be transmitted to mono channel, s_i is an object signal, and a_i is an object gain value information of an object contributing to each channel.

1.2.2 Object Gain Ratio Information

The object gain information comprises further the object gain ratio information as well as the object gain value information. The object gain ratio information includes a ratio value between the gains of each object contributing to each channel of the downmix signal.

The object gain ratio information can be used to process the downmix signal by the downmix processing unit 1200, thereby obtaining the processed downmix to be transmitted through 2 (i.e. stereo) and more channels.

In the case of the stereo channel, the downmix signal can be obtained from Formula 3 using the object gain ratio information.

$$x_1=\mathrm{sum}\{a_i*s_i\}$$

$$x_2=\mathrm{sum}\{b_i*s_i\}$$ [Math Figure 3]

where x_1 and x_2 are downmix to be transmitted, respectively, s_i is an object signal, and a_i and b_i are an object gain value information of an object contributing to each channel.

$$m_i=a_i/b_i$$ [Math Figure 4]

where m_i is an object gain ratio information of each object.

The object gain information, i.e. the object gain value information (a_i and b_i) and the object gain ration information (m_i) can be transmitted to a information generating unit 1100 in various combination of the object gain information contained in a bitstream. The combinations include, for example, (a_i, b_i), (m_i, a_i) and (m_i, b_i).

Alternatively, when the object gain information is transmitted to the information generating unit 1100 in a combination of object gain value information (a_i, b_i), the object gain value information can be scaled. If there is a convention that b_i be scaled to 1, though object level information and only a_i as an the object gain information is transmitted, the information generating unit 1100 can reconstruct the object information according to the convention. By scaling the object gain value, the number of the information to be transmitted to the information generating unit 1100, can be reduced.

Alternatively, the object gain ratio information (m_i) can be obtained from with a various value as Formula 5.

Figure 5:
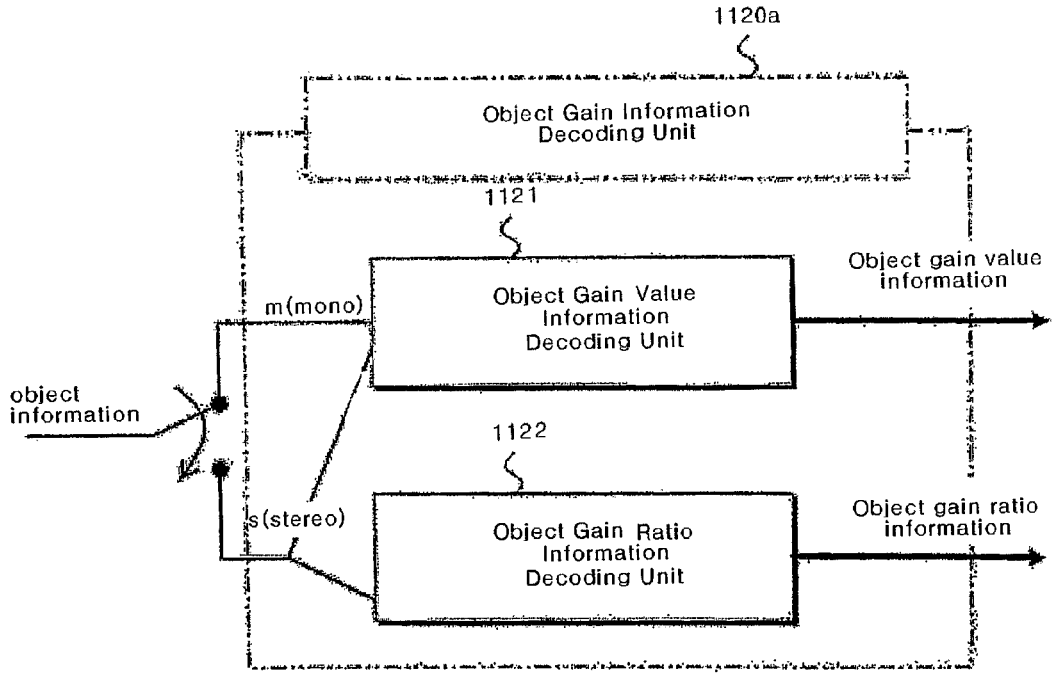
FIG. 5 is an exemplary block diagram of a object gain information decoding unit according to one embodiment of the present invention.

[Math FIG. 5]

$$m_i=a_i/b_i, \quad (1)$$

$$m_i=(a_i+\alpha)/(b_i+\beta), \quad (2)$$

$$m_i=(a_i*s_i)/(b_i*s_i) \quad (3)$$

($\alpha$, $\beta$ is a very small number to prevent a numerator and a denominator to zero.)

In case of Formula 5, same m_i value may not be included same value of a_i and b_i. For example, in case of 1) a_i=0.5, b_i=0.5, 2) a_i=2, b_i=2, all of case has same m_i (=1), but the cases have different values of a_i, b_i.

Figure 6:
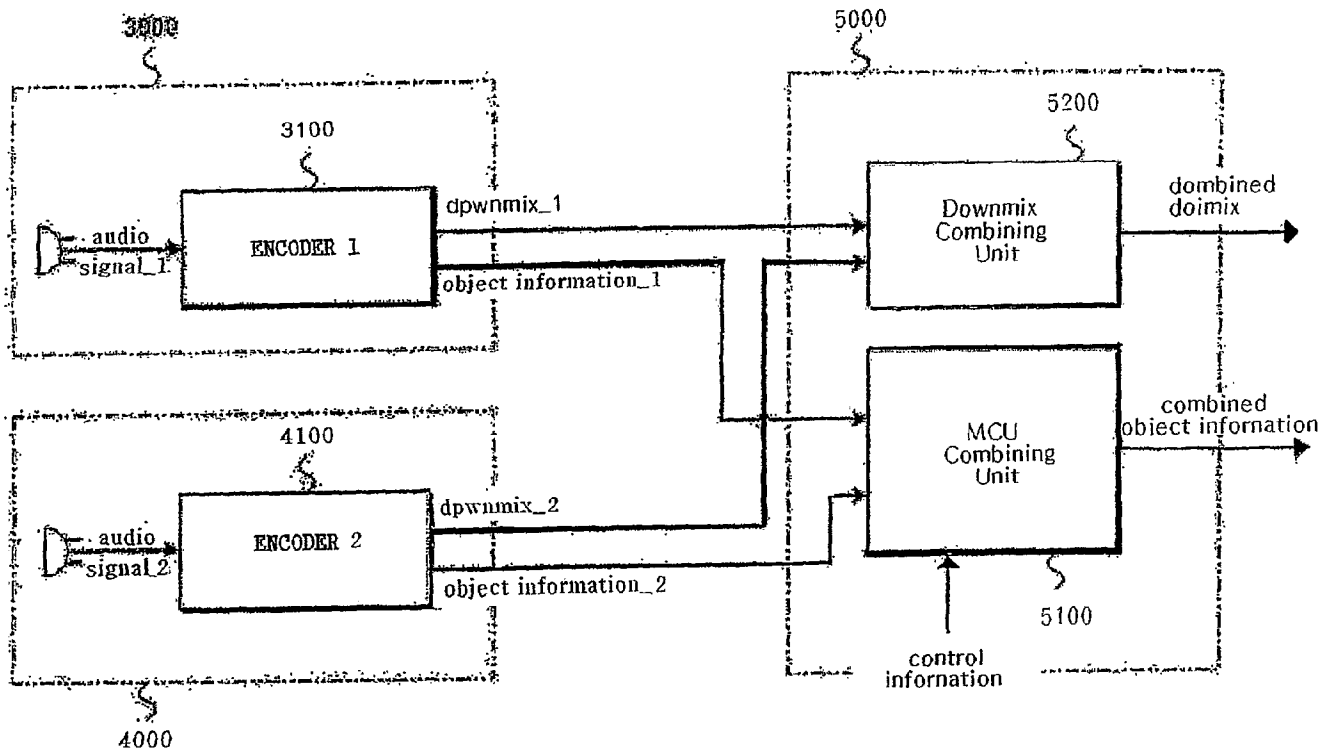
FIG. 6 is an exemplary block diagram of an apparatus for processing an audio signal according to other embodiment of the present invention.

To obtain the processed downmix to be transmitted through each channel, new method can be used as Formula 6:

$$x_1=\mathrm{sum}\{a_i'(n)*s_i'(n)\},$$

$$x_2=\mathrm{sum}\{b_i'(n)*s_i'(n)\}$$ [Math Figure 6]

(wherein a_i' and b_i' are values satisfied the following conditions, $$(a_i'+b_i'=C) \text{ or } (a_i'^2+b_i'^2=C) \text{ or } (a_i'=C \text{ or } b_i'=C),$$

wherein s_i'=g_i*s_i)

Finally, the object gain ratio information can be transmitted m_i'(=a_i'/b_i'). The number of the information to be transmitted to the information generating unit 1100 can be reduced.

1.3 Object Correlation Information

Referring to FIG. 4, the information decoding unit 1100 receives an object correlation information. The object correlation information is estimated between two objects and represents the correlation/coherence between two objects.

In case that the two object signals are different object of same origin, the object correlation information can be existed.

First, if the object signals are stereo objects, mono object can be generated using the stereo objects, and the descendant object information indicating relations between channels of the stereo objects can be estimated using the stereo objects (hereinafter, this method is 'mono method').

In this case, the object level information is generated using the object level of the mono object.

Second, stereo objects are recognized as two individual mono objects signal. In this case, the object level information is generated using the two individual mono objects level (hereinafter, this method is 'stereo method'). The amount of information to be transmitted using the second method has more than that of using the first method.

To process a stereo object, for example, a first channel signal of stereo objects may be s_i, a second channel signal of stereo objects is s_j as each mono object signal.

The object level of above channel signal may be Ps_i, Ps_j.

In case of a stereo object, each object's characteristic representing L and R channels of given object is similar to each other. So, the object correlation information can be used to represent similarity between the objects information.

Therefore, to encode Ps_i and Ps_j, each mono object using stereo method is considered coupling constituted same object.

Figure 7:
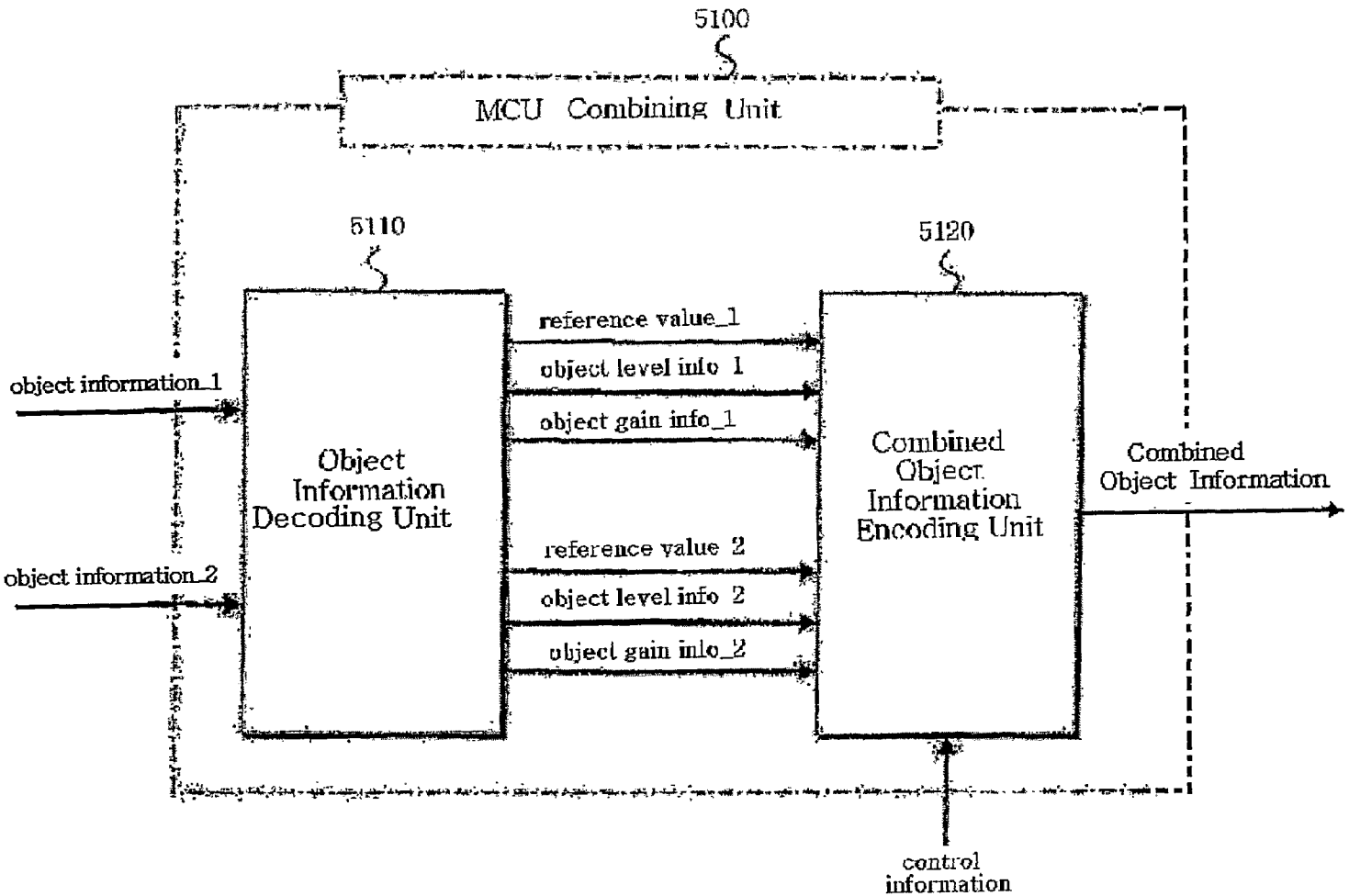
FIG. 7 is an exemplary block diagram of a MCU combining unit according to one embodiment of the present invention.

The object correlation information can be generated using the representative as follows.

$$Ps_i,j/sqrt(Ps_i*Ps_j)$$ [Math Figure 7]

The object correlation information represents relation between objects, whether or not the objects are both channels of the same stereo or multi-channel object, that is, each object is a different channel of same origin.

Figure 8:
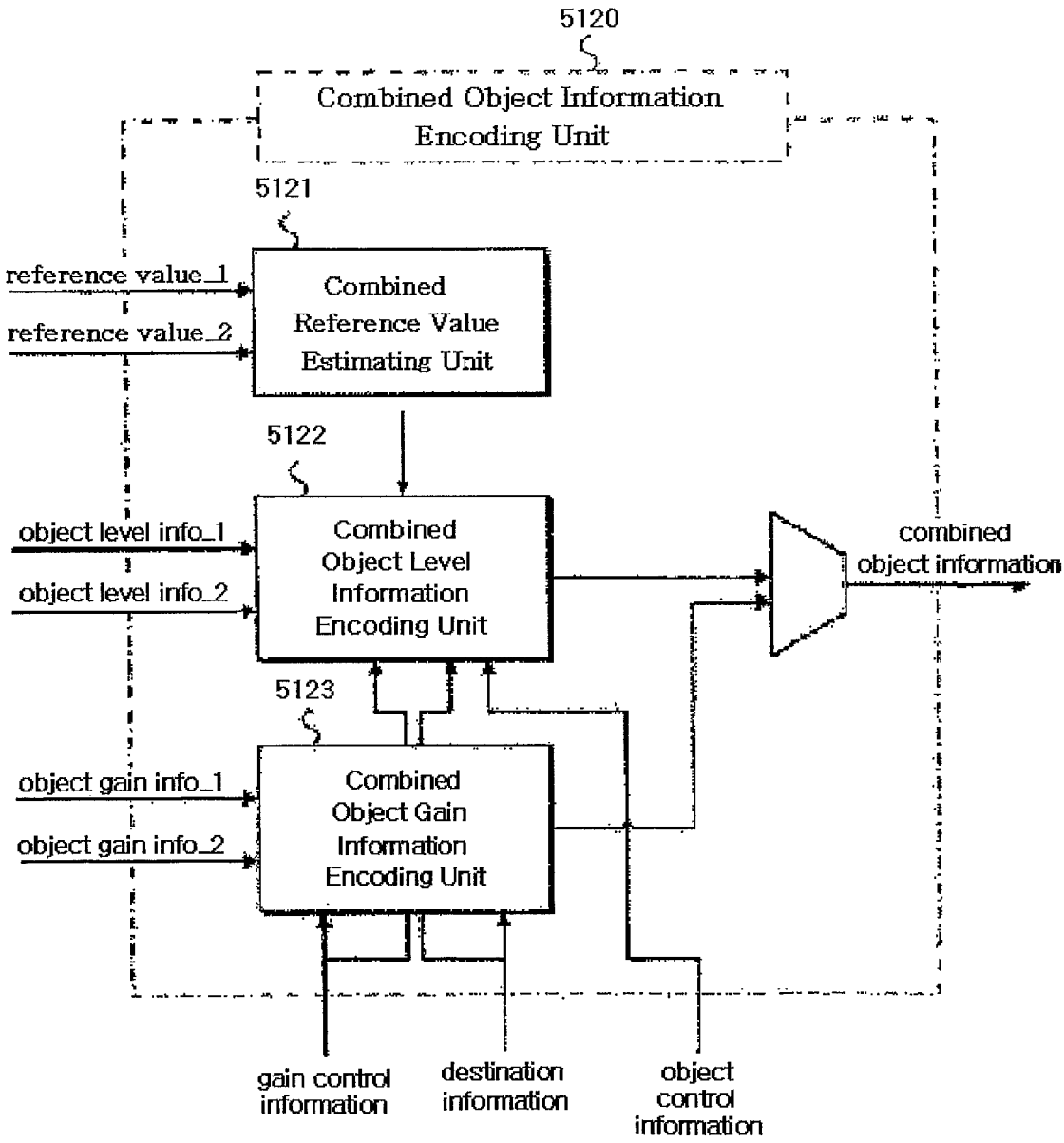
FIG. 8 is an exemplary block diagram of a combined object information encoding unit according to one embodiment of the present invention.

To reduce the transmitted bits of the object information, it is effective to use further the object difference information. For example, an object information includes an object level of left channel of stereo object and an object difference information which can be represented in Formula 8. It can be assumed that the level difference between left and right channel is not so large, it is more efficient to encode the object difference information than to encode the object level of the right channel.

$$Ps_j'=Ps_j/Ps_i \text{ or}$$

$$Ps_j'=10\log 10(Ps_j)-10\log 10(Ps_i)=10\log 10(Ps_j/Ps_i) \quad \text{[Math Figure 8]}$$

Figure 9:
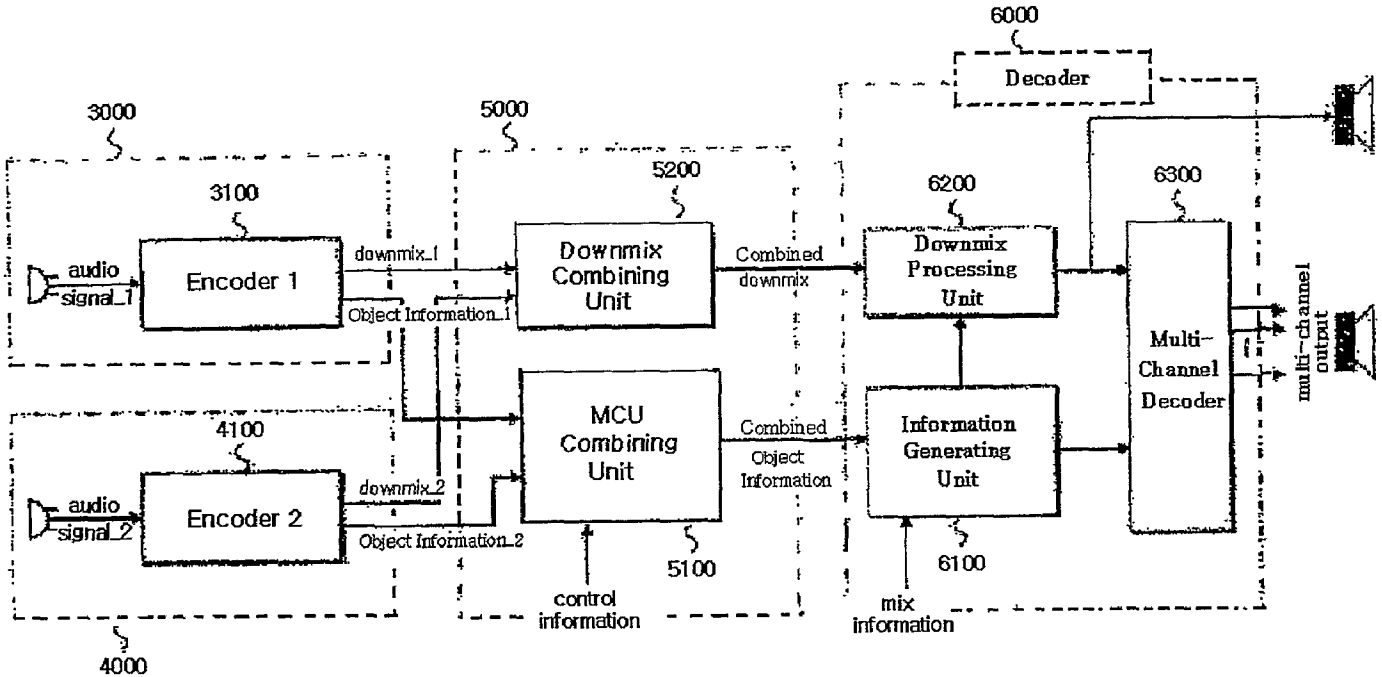
FIG. 9 is an exemplary block diagram of an apparatus for processing an audio signal according to one embodiment of the present invention.

Alternatively, the object information can be included with the object sum and difference information rather than the object level information of the individual channel as follows:

$$M=(L+R)/2,\ S=(L-R)/2,$$

$$Ps_M=(Ps_L+Ps_R)/2,\ Ps_S=(Ps_L-Ps_R)/2 \quad \text{[Math Figure 9]}$$

Using the object sum (Ps_M) and difference (Ps_S) information can improve transmission efficiency and be easy to perform balancing of the quantization error.

The number of the object correlation information varies according to number of different object of same origin. In order to reduce the bit rate of a object information. A flag information correlation_flag indicating whether an object is a part of a stereo or a multi-channel object, and can be received from the object information. The correlation_flag can be included in the object information, and received the information generating unit 1100.

Meaning of the flag information correlation_flag is shown in the following Table 1.

TABLE 1

| Correlation_flag | Meaning |
|---|---|
| 1 | correlation |
| 0 | No correlation |

In case that 'correlation_flag' is equal to 0, the object correlation information is not transmitted to the object correlation information decoding unit 1130*a*. When the 'correlation_flag' is not received in the decoder 1000 or 2000, default value of the correlation information can be used to process the downmix signal.

Otherwise ('correlation_flag' is equal to 1), the object correlation information is transmitted to the object correlation information decoding unit 1130*a*.

Besides, the object information further includes the reference information separately. When the reference information exists, the reference information can be an identifier for a MCU combiner.

A method of encoding an audio signal according to the present invention comprises the step of receiving a multi-object audio signal and the step of generating a downmix signal and an object information including an object level information, an object gain information, and an object correlation, the object level information and the object correlation information from the multi-object audio signal, characteristics of the object level information, the object gain information, and the object correlation is same as that of the decoding method. So, the method of encoding an audio signal according to the present invention may not be limited as above identified.

Additionally, an apparatus of encoding an audio signal according to the present invention comprises a downmixing unit generating a downmix signal from a multi-object audio signal, and an object information generation unit extracting an object information including an object level information, an object gain information, and an object correlation information from the multi-object audio signal. The apparatus of encoding for an audio signal may not be limited as above identified.

2. MCU Combiner

An audio signal can be used in conventional MCU downmixing audio signals to control output in a remote conference and so on. In case that the multi-channel audio signal includes vocal, piano, narration. As occasion demands, we can't delete or control a special kind of object signals when we only use or listen piano signal without vocal and narration or only make a communication with someone in a teleconference.

However, when the audio signal comprises multi-object signals, to use object information of the audio signal is effective to control object gain and panning corresponding to characteristic of each object signal. Additionally, the decoding method of the present invention using object information may be used in an enhanced karaoke system.

FIG. 6 is an exemplary block diagram of an apparatus for processing an audio signal according to an embodiment of present invention. Referring to FIG. 6, an apparatus for processing an audio signal according to embodiment may comprise an encoder 1 3100, an encoder 2 4100, a combining unit 5000 including a MCU combining unit 5100 and a downmix combining unit 5200. The encoder 1 3100 and the encoder 2 4100 can be configured to receive each an audio signal_1 or an audio signal_2, and to generate a downmix_1 and an object information_1 in the encoder 1 3100, and to generate a downmix_2 and an object information_2 in the encoder 2 4100.

The combining unit 5000 can be configured to receive the downmix_1 and the object information_1 from the encoder 1 3100, the downmix_2 and the object information_2 from the encoder 2 4100, and a control information, and to generate a combined downmix and a combined object information.

The combined downmix, output signal of the combining unit 5000, can be generated a conventional downmixing unit. Therefore, details of elements of the downmix combining unit 5200 shall be omitted.

2.1 Combined Object Information

FIG. 7 is an exemplary block diagram of an apparatus for processing an audio signal according to an embodiment of present invention, in particular, an exemplary block diagram of an MCU combining unit 5100. Referring to FIG. 7, the MCU combining unit 5100 can be configured to generate a combined object information using the object information_1, the object information_2, and the control information. The combined object information includes information corresponding to the downmix_1 from the encoder 1 3100 and the downmix_2 from the encoder 2 4100. The MCU combining unit 5100 includes an object information decoding unit 5110 and a combined object information encoding unit 5120. The object information decoding unit 5110 can be configured to receive the object information_1 from the encoder 1 3100 and the object information_2 from the encoder 2 4100, and to decode a reference information_1, an object level information_1, and an object gain information_1 from the object information_1, and a reference information_2, an object level information_2, and an object gain information_2. The reference information, the object level information, and the object gain information are same as that of FIG. 1~FIG. 6. Therefore, details of decoding method of those informations shall be omitted.

And the MCU combining unit 5100 can be configured to receive at least two object informations from multiple encoders without limitation of input signals, and to generate the combined object information corresponding to the combined downmix.

2.2 Control Information

FIG. 8 is an exemplary block diagram of an apparatus for processing an audio signal according to an embodiment of present invention, in particular, an exemplary block diagram of a combined object information encoding unit 5120. Referring to FIG. 8, the combined object information encoding unit 5120 can be configured to receive reference value_i, object level information_i, object gain information_i, and a control information, and to generate a combined object information to be inputted to a decoder (not shown).

The combined object information may be made by combination of at least two sets of object information, for example, the object information_1 and the object information_2, referring to the control information in the combined object information encoding unit 5120.

The control information includes an object control information and a gain control information, and the gain control information may include a destination information. Each of the object control information, the gain control information, and the destination information may explain the followings.

2.2.1 Object Control Information

The object control information may determine a object subset of the object information to be included in the combined object information. The object control information can determine a required subset of audio objects of object information_1 or object information_2 and their order to be included in the combined object information.

The object level information may be processed by the object control information in the combined object level information encoding unit 5122. The combined object information may include information corresponding to some objects determining by the object control information, and can be use according to several purposes.

For example, the object information_1 comprises music including a vocal, a piano, a guitar object signals, and the object information_2 comprises a violin, a vocal object signal. To generate an audio signal comprising piano, guitar, violin object signals, we can obtain the combined object information using the object control information from user control without vocal object signals.

2.2.2 Gain Control Information

The combined object gain information encoding unit 5123 can be configured to receive a gain information_1 from the object information_1, a gain information_2 from the object information_2, a gain control information, and a destination information, and to generate a combined object gain information.

The gain control information may be used to control object downmix gain for downmix combining unit. In contrast to the object control information, the gain control information may process object information in the combined object level information encoding unit 5122 and the combined object gain information encoding unit 5123, the object information is selected using the object control information in the combined object level information encoding unit 5122. The gain control information may be a value within in the range of 0~1.

2.2.3 Destination Information

Among the range of the gain control information, if the gain control information corresponding to a set of an object information_i is 0, the object information does not included in the combined object information. In case that the gain control information is 0 or 1, the gain control information can be regarded as a destination information. The destination information may indicate a direction of the downmix signal.

The destination information can be used for special function, for example, a whisper function, a secret meeting, and for controlling the destination of an object signal.

Referring to the FIG. 8, the destination information may be inputted into the combined object gain information encoding unit 5123, and process the gain information_1 and the gain information_2 to control object gain of the combined object information.

2.3 Process of Generating a Combined Object Information

FIG. 8 is an exemplary block diagram of the combined object information encoding unit 5120. Referring to FIG. 8, the combined object information encoding unit 5120 can be configured to receive a reference value_1, a reference value_2, an object level information_1, an object level information_2, an object gain information_1, an object gain information_2, an object control information, a gain control information, and a destination information, and to generate a combined object information using the object control information, the gain control information, and the destination information.

2.3.1 Estimation of Reference Information

Again referring to FIG. 8, the combined object information encoding unit 5120 includes a combined reference value estimating unit 5121, a combined object level information encoding unit 5122, and a combined object gain information encoding unit 5123.

To generate the combined object information, first, a reference information of the combined object information may be estimated. Each object information_i may include reference information to normalize each object level, and to generate an object level information. In case of combining at least two sets of object information to generate a combined object information, the combined object information may be estimated with a combined reference information (new value) using at least one of the reference information of the object information for generating the combined object level information.

The combined reference information may be determined by several methods. For example, the reference information of the combined object information may be the reference information_1 or the largest reference information of the object information_i.

2.3.2 Combined Object Level Information

The combined reference information generating unit 5121 may estimate the combined reference information as the above method. Before the change of the combined reference information, the object level information_i is normalized using the reference information_i.

We assume that the object level information of the object information_1 is the [formula 10], and the combined object level information is the [formula 11].

$$OL_1i=Ps_1i/Ps_1r \quad \text{[Math Figure 10]}$$

(where OL__1i is a $i^{th}$ object level information of the object information_1, Ps__1r is a reference information of the object information_1, Ps__1i is a $i^{th}$ object level of the object information_)

$$OL_ck=OL_1i*Ps_1r/Ps_cr \quad \text{[Math Figure 11]}$$

(where OL_ck is a $k^{th}$ object level information of the combined object information, Ps_cr is a reference information of a combined object information.)

2.3.3 Combined Object Gain Information

The combined object gain information encoding unit 5123 can be configured to receive an object gain_1, an object gain_2, a gain control information, and a destination information, and to generate an combined object gain information using the gain control information and the destination information. The object level information may be controlled to be included in the combined object information by the gain control information. Especially, the gain control information controlling direction of the downmix signal refers a destination information. In case that the destination information indicates on/off of the object information, that is, the destination information is 0 or 1, the object gain information of the object information_i is 0 or a gain for $i^{th}$ object.

The destination information may be contained in an object information or inputted from user control. In case that the gain control information may be contained or inputted, the object gain information_1 and the object gain information_2 can be changed using the gain control information.

2.3.4 Combined Object Correlation Information

The object correlation information indicates similarity/dissimilarity between the channels of a stereo object or a multichannel object, so the object correlation information may be affected by combining object information in the MCU combining unit 5100.

The combined object correlation information may be determined by several methods. The simplest method is used the object correlation information of the object information_i untouched.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

Accordingly, the present invention is applicable to encode and decode an audio signal.

The invention claimed is:

1. A method for processing an audio signal, comprising:

receiving at least two downmix signals, and at least two sets of objection information;

generating a combined downmix by downmixing the at least two downmix signals;

identifying whether reference information is included in each of the at least two sets of object information, the reference information being used for generating combined object information;

when the reference information is included in each of the at least two sets of object information, obtaining the reference information indicating a largest object level of object signals included in each of the at least two downmix signals;

generating the combined object information by using the at least two sets of object information based on the reference information;

receiving mix information;

generating downmix processing information using the combined object information and the mix information; and processing the combined downmix using the downmix processing information.

2. The method of claim 1, wherein the generating combined object information further uses control information.

3. The method of claim 2, wherein the control information comprises an object control information.

4. The method of claim 3, wherein the object control information determines an object subset to be included in the combined object information.

5. The method of claim 2, wherein the combined object information comprises at least one of combined reference information, combined object level information, and combined object correlation information.

6. The method of claim 5, wherein the combined reference information is estimated using object levels of all object signals included in the at least two sets of the object information.

7. The method of claim 6, wherein the object levels are calculated by using the reference information and object level information of the at least two sets of the object information.

8. The method of claim 5, wherein the combined object level information is calculated using the combined reference information.

9. The method of claim 1, wherein the combined downmix is received from a downmix combining unit.

10. The method of claim 1, wherein the combined object information is received from a MCU combining unit.

11. The method of claim 1, wherein the downmix signal is received as a broadcast signal.

12. The method of claim 1, wherein the downmix is received from a digital medium.

13. An apparatus for decoding processing an audio signal, the apparatus comprising:

a processor including a downmix combining unit, a MCU combining unit, an information generating unit, and a downmix processing unit, wherein the downmix combining unit receives at least two downmix signals, and generates a combined downmix signal by downmixing the at least two downmix signals, wherein the MCU combining unit receives at least two sets of object information, and identifies whether reference information is included in each of the at least two sets of object information, the reference information being used for generating combined object information, and when the reference information is included in each of the at least two sets of object information, obtains the reference information indicating a largest object level of object signals included in each of the at least two downmix signals, and generates combined object information by using the at least two sets of object information based on the reference information, wherein the information generating unit receives the combined object information and mix information, and generates downmix processing information using the combined object information and the mix information, and wherein the downmix processing unit receives the combined downmix and the downmix processing information, and processes the combined downmix using the downmix processing information.

* * * * *